US005975187A

United States Patent [19]

Chou

[11] Patent Number: 5,975,187

[45] Date of Patent: Nov. 2, 1999

[54] SELF-CENTERING DISTRIBUTED LOAD BLIND & DRAPERY SYSTEM

[76] Inventor: Tser-Wen Chou, 19464 Via Del Caballo, Yorba Linda, Calif. 92686

[21] Appl. No.: 08/912,290

[22] Filed: Aug. 15, 1997

[51] Int. Cl.[6] ..... A47H 5/00

[52] U.S. Cl. ..... 160/345; 160/168.1 V

[58] Field of Search ..... 160/173 V, 345, 160/346, 168.1 V, 176.1 V; 16/87.4 R, 87.6 R, 91, 95 D, 96 D, 96 L, 107, 98

[56] References Cited

U.S. PATENT DOCUMENTS

| | | | |
|---|---|---|---|
| 3,098,520 | 7/1963 | Greenstadt et al. | 16/95 D X |
| 3,107,947 | 10/1963 | Hulterstrum | 16/107 |
| 3,602,150 | 8/1971 | Frost et al. | 16/98 X |
| 3,708,827 | 1/1973 | Foltz | 16/98 |
| 3,787,925 | 1/1974 | Dawson | 16/107 |
| 3,951,076 | 4/1976 | Knudsen et al. | 16/98 X |
| 4,122,884 | 10/1978 | Salzmann | 160/900 X |
| 4,261,408 | 4/1981 | Debs | 160/900 X |
| 4,293,021 | 10/1981 | Arena | 160/173 V X |
| 4,742,860 | 5/1988 | Debs | 160/168.1 V X |
| 4,798,149 | 1/1989 | Hoffmann | 16/98 X |
| 4,846,249 | 7/1989 | Cooper et al. | 160/345 |
| 5,349,783 | 9/1994 | Jasperson et al. | 16/91 X |
| 5,522,445 | 6/1996 | Hoffman | 16/87.4 R X |

*Primary Examiner*—David M. Purol
*Attorney, Agent, or Firm*—Curtis L. Harrington

[57] ABSTRACT

An improved wall covering track system includes an elongate track for vertically supporting a series of carriers and enabling the carriers to horizontally translate along the track, the raceway surfaces of the track are inclined downwardly from the horizontal, the carriers have frusto-conical wheels, which may be mounted on straight or frusto conical axles. A drapery and a vertical blind system includes spacers, and a variety of track extrusions are illustrated.

6 Claims, 7 Drawing Sheets

SELF-CENTERING DISTRIBUTED LOAD BLIND & DRAPERY SYSTEM

FIELD OF THE INVENTION

The present invention relates to the field of window coverings and more particularly for improvements in tracks and associated components which improve performance, load distribution, and provide for self centering, even where lateral forces periodically act to dis-align the blinds suspended from the track.

BACKGROUND OF THE INVENTION

Conventional support and track systems for vertical blinds and draperies have included flat walled extrusions having horizontally extending and completely flat surfaces for supporting the wheels of a carrier. Draperies have included a narrower version of this structure, since draperies do not require a wider working area to support and house vertical blind actuating mechanical rod and gear structures.

The carriers for both draperies and vertical blinds have supported a completely horizontal axle for rotatable support of a wheel. The wheel width is quite thin, and the wheel width is one or two tens of magnitudes narrower than the carrier. Because the wheels have a narrow horizontal area, the tolerances between the carriers and the track have to be fairly close, not only to keep the carriers on track, but also to make certain that lateral forces on the vertical blind units or draperies will not cause the carriers to become untracked.

Part of this goal is achieved by having a relatively wide track and wide carrier, to provide bending moment resistance. However, the trend in window coverings is to try to provide a track which is as narrow as possible and as short as possible, so that a greater variety of window and window casement geometries can be accommodated. Narrower tracks and supported structures must not sacrifice their ability to effectively support and move the window covering structure, nor compromise structural integrity needed for long life and superior service.

Open windows are subjected to breezes and wind which can place significant lateral force on the window covering support devices supported by the track. Where the support devices cannot move somewhat laterally, they must be designed large enough and strong enough to directly fight the lateral forces, even to the point of failure. If the conventional track and support devices were enabled to allow lateral displacement, it would require the track to be pivotally mounted at the ends, causing an even larger track to prevent sagging in the middle, or require multiple pivotal mountings. Even this would not help where wind or breeze was providing force to one part of the structure alone, since the vertical blinds or window covering affected would bend against the track and the track would attempt to be angularly displaced, bending against the vertical blind portions not affected by the force of the breeze.

Once the breeze forces have subsided, both on conventional blinds and draperies, any angular displacement which has occurred, will remain. The draperies or vertical blinds will remain out of alignment, will look uneven, and may even be in ajammed position so that they will not operate properly to translatably support the vertical blind or drapery.

What is therefore needed is window covering system support structures which can permit lateral movement with respect to a rigidly mounted track, but which will allow the draperies and vertical blinds supported to come back into a straight alignment with respect to the track. Further, the inventive system should provide for a smaller drapery and curtain rod support and translation system in which the loads experienced by the parts thereof are better distributed and the parts thus have better integrity.

The needed system will enable a lesser tolerance between the track and the translating components, not only to provide clearance necessary to enable the supported draperies and vertical blinds to become laterally angularly displaced, with the support structures to be angularly displaced within the track, but without becoming dislodged from, jammed, or stuck with respect to the track.

The system should have axles and wheels which distribute the forces adequately and efficiently, and which, unlike conventional systems, prevent the binding or jamming of the leading edge of a wheel on one side of the carrier and the trailing edge of a wheel on the other side of the carrier from the carrier turning within its closely toleranced track.

In addition, the needed extrusion must be easy to make and should have as few sharp angles immediately adjacent the support track to enable more material to be employed for supporting the track. Conventional tracks have right angled edges of the wheels of the carrier running close to a right angled space within the carrier as much as possible. This requires any reinforcing material to be added to the outside of the track, making the track wider and thicker, rather than allowing it to be added to the inside, to add strength without adding external dimension.

SUMMARY OF THE INVENTION

An improved wall covering track system includes an elongate track for vertically supporting a series of carriers and enabling the carriers to horizontally translate along the track, the raceway surfaces of the track are inclined downwardly from the horizontal, the carriers have frusto-conical wheels, which may be mounted on straight or frusto conical axles. A drapery and a vertical blind system includes spacers, and a variety of track extrusions are illustrated.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
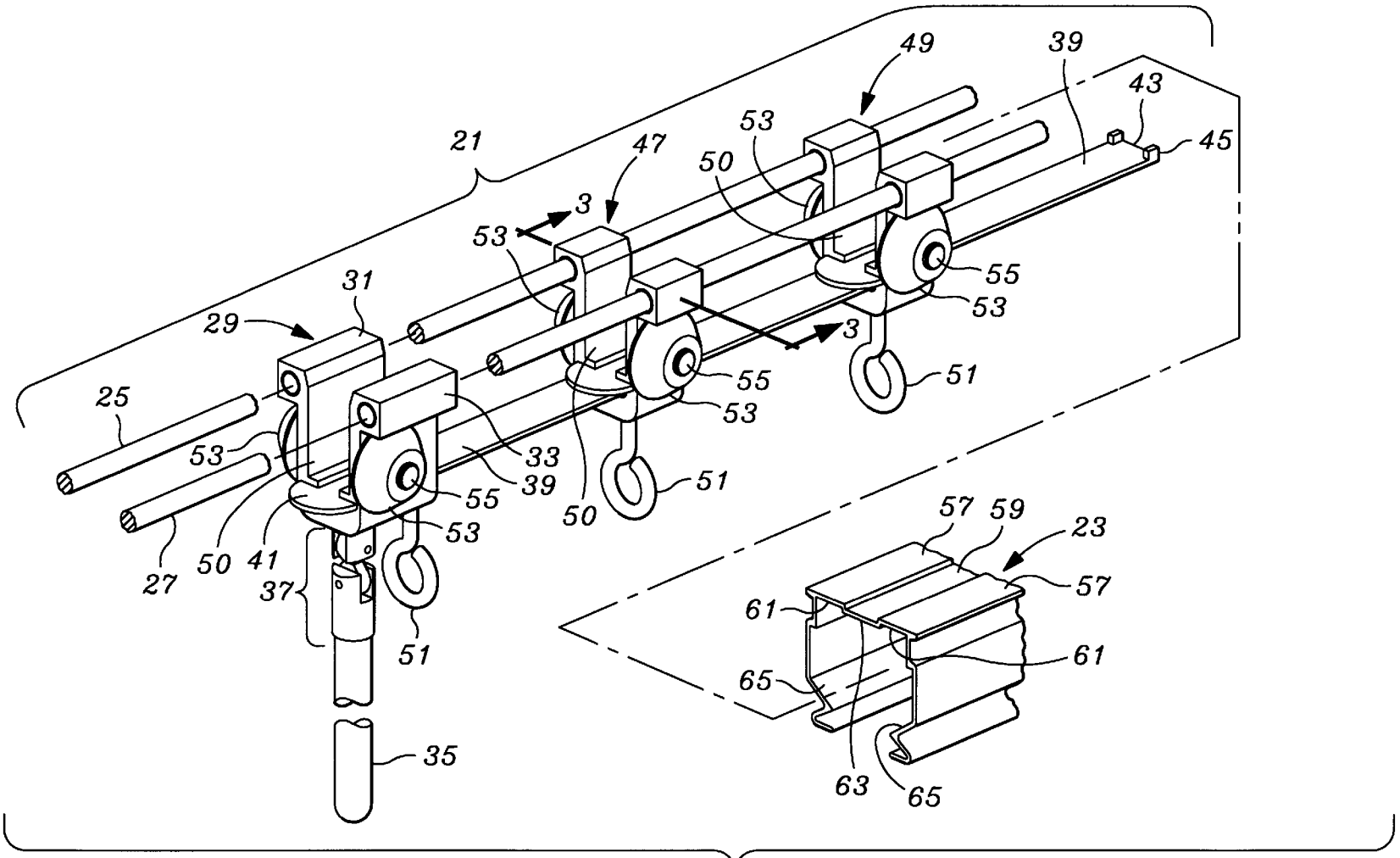
FIG. 1 is a perspective partially exploded view of the system used with a drapery configuration having drapery carriers and a relatively narrower drapery track, and lowered spacers.

The description and operation of the invention will be best initiated with reference to a drapery configuration which shown in FIG. 1. FIG. 1 is perspective partially exploded, distributed view illustrating a pull drapery system 21 made up of structures which are shown outside of their supporting rail or traclk 23, which is shown at the bottom right of FIG. 1. Beginning at the lower left of FIG. 1, a pair of pull ropes include rope 25 and rope 27 which first extend through a pulled carrier 29. The pulled carrier 29 has a pair of upper blocks 31 and 33 through which the ropes 25 and 27 pass, and through which one of the ropes 25 and 27 may be attached to engage the pulled carrier 29 to enable one of the ropes 25 and 27, after they have passed through the pulled carrier 29 to be looped through a pulley such that as the ropes 25 and 27 move oppositely with respect to each other in one direction, any attached draperies (not shown) will close, and in the other direction they will open.

In addition, the pulled carrier 29 is shown supporting a pull wand 35 attached through a universal swivel assembly 37, where it is desirable to manually move the pulled carrier 29. The universal swivel assembly 37 insures that no matter the direction of pull of the pull wand 35, even at an unusual angle, the swivel assembly 37 will move to enable the pull wand 35 to freely pivot with respect to the pulled carrier 29. Although both ropes 25 and 27 are shown, as well as the pull wand 35, it is clear that many drapery sets will probably have one or the other, but both may be present as a backup in the event of a malfunction of the other.

In general, the pulled carrier 29 may have an overall "U" shape, and the area between the blocks 31 and 33 may be well defined to garner some orientational support from the traclk 23, as will be shown. A series of slidably displaceable spacer tabs 39 each have a head end portion 41, which is a horizontally enlarged portion, and a tail end portion 43 with a vertically extending portion 45, to enable both the pull carrier 29, and a series of follower carriers 47 and 49 (only two are shown) to contract to a closely spaced orientation when the draperies would normally be open, and to extend to a widely and evenly spaced orientation when the draperies would normally be extended to close over a window or door.

The head end portions 41 can fit through an upper "U" shaped space 50 in each succeeding one of the carriers 29, 47, and 49 enabling the head end portions 41 to "stack" within the "U" shaped space 50. Each of the carriers 29, 47, and 49 has a vertically downwardly extending support loop 51 for attachment of the curtain to be supported.

Importantly, each of the carriers 29, 47, & 49 have a pair of wheels 53 which have a frusto-conical shape, which is the shape of the bearing surfaces of the wheels 53 on the inside of track 23. Further, each of the wheels 53 are supported by axles 55 which may also have a frusto conical shape, matching the internal bearing of the wheels 53 which may also be frusto-conically shaped. The button shaped end of the axles 55 are shown, and expand slightly outside of the wheels 53 in order to lock the wheels 53 into a kept relationship with the axles, but allowing rotation.

Referring to the supporting track 23, this member is preferably a single extrusion having an upper surface defined by a pair of spaced apart, parallel raised portions 57 extending along the length of the track 23 and in the same plane. The raised portions 57 are preferably formed integrally with a central depression portion 59. The exterior shapes of the raised portions 57 and central depression portion 59, are complementary to an internal set of shapes, including a pair of internal raised portions 61 and a central internal depression 63. The pair of upper blocks 31 and 33 of the carriers 29, 47 & 49 fit within the internal raised portions 61, and the central internal depression 63 fits shallowly into the space between the pair of upper blocks 31 and 33, generally over the upper extent of the "U" shaped space 50. This helps to stabilize the carriers 29, 47, and 49 in their travel through the track 23.

Referring again to track 23, a pair of inclined raceways 65 provide a sloped surface on which the frusto-conical surface of the wheels 53 ride. The inclined raceways 65 cause the carriers 29, 47 & 49 to always be centered within the track 23, even after being laterally displaced to one side or the other. Because the wheels 53 have a frusto-conical bearing surface, the carriers 29, 47 & 49 will not tend to ride up on either side of the track 23. The existence of the spacer tabs 39, internal depression 63, and inclined raceways 65 provide stable operation.

Figure 2:
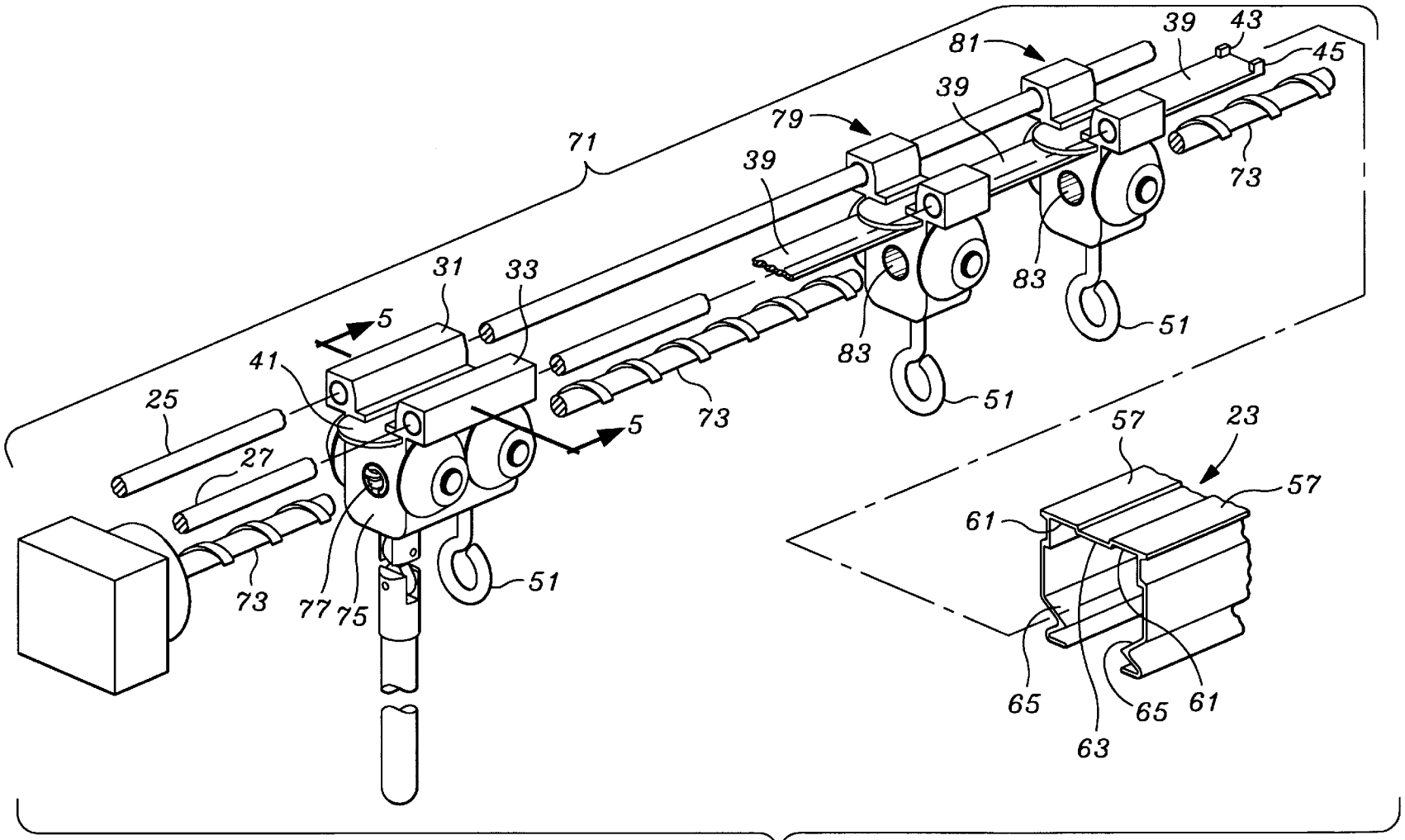
FIG. 2 is a perspective partially exploded view of the system used with a drapery configuration having drapery carriers similar to the view of FIG. 1, but where the carriers have with a centrally located worm gear for remotely advancing the carriers and where the spacers are raised to accommodate the worm gear.

Referring to FIG. 2, a variation on the system 21 is shown as a motorized drapery system 71 also shows the optional ropes 25 & 27, but has a centrally extending worm gear 73 attached to a block shaped motor shown to the left of FIG. 2. Also shown is a lead carrier 75 which has an internally geared bore 77 which engages the worm gear 73. The other carriers shown include carriers 79 and 81 and each has a smooth bore 83. The smooth bores 83 let the lead carrier take all of the force of opening and closing the draperies. Note that the bores 77 and 83 displace the spacer tabs 39 upward.

Figure 3:
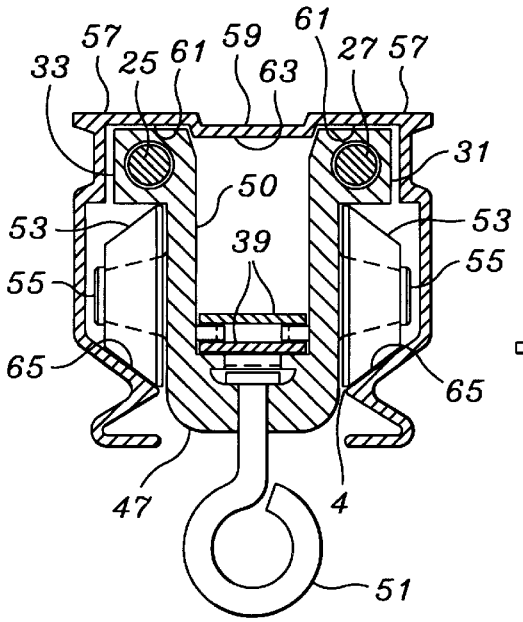
FIG. 3 is a sectional view of the embodiment of FIG. 1 illustrating the carrier within the track and showing the engagement of frusto-conical wheels on the sloped raceways.

Referring to FIG. 3, a sectional view of the carrier 47 of FIG. 1 taken along line 3—3 illustrates in greater detail the structures associated therewith, and also, shown in phantom, the profile of the frusto conical axle 55. As can be seen, the downwardly extending support loop is mounted in swivel fashion where it is allowed to turn about its axis of connection with the carrier 47. Also seen is the fit of the central internal depression 63 into the space between the pair of upper blocks 31 and 33. Note that the transition between the central internal depression 63 and the pair of internal raised portions 61 is an angled transition.

Figure 4:
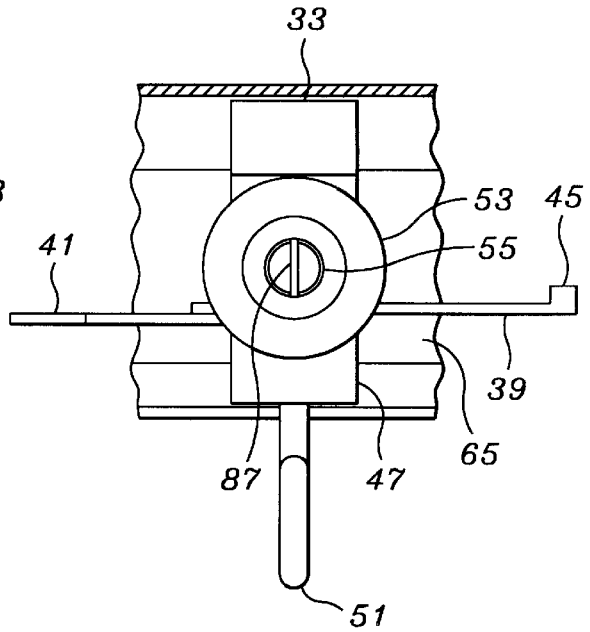
FIG. 4 is a side view of the carrier of FIG. 3.

Referring to FIG. 4, a side sectional view of the track 23 illustrates the carrier 47. The combination of FIGS. 3 and 4 illustrate that the operation of the axle 55 is preferably via snap fit. The axle 55 has a split groove 87 which enables it to have an enlarged tip end which can be compressed together to enable the wheels 53 to fit over the end of the axle 55, with the enlarged tip end of the axle 55 to snap back outward to capture the wheel 53 onto the axle 55.

As can be seen in FIG. 3, the axle 55, as it extends toward the body of the carrier 47, conically expands. The inner bearing surface of the wheel 53 has a conical bore which matches the conical outside of the axle 55. Referring again to FIG. 3, it can be seen that the force from the inclined raceway 65 is directed into the wheel 53 in a direction toward the upper body of the carrier 47. The force from the wheel 53 is directed toward the conical outer surface of the axle 55. The axle 55 has greater holding capacity for three main reasons. First, since it is conical, the base of the axle 55 has a greater connection with the body of the carrier 47. Ideally, the axle 55 and carrier 47 is formed integrally through the injection molding process. The enlarged base gives the axle 55 a greater bearing area, and for a given material having a given strength, much greater load supporting capability for a given or smaller size of carrier 47. Secondly, since the force components are directed toward the upper middle of the body of the carrier 47, the shear force on the axle is reduced. Thus, for a given material having a given strength, much greater load supporting capability, through reduced shear stress, is capable for a given or smaller size of carrier 47. Thirdly, the frusto-conical bearing surface of the exterior of the axle 55 and the frusto-conical bearing surface of the interior of the wheel 53 provide for an expanded surface for transmission of forces of support of the draperies suspended from the downwardly extending support loop 51. This will result in longer wear and better support.

Figure 5:
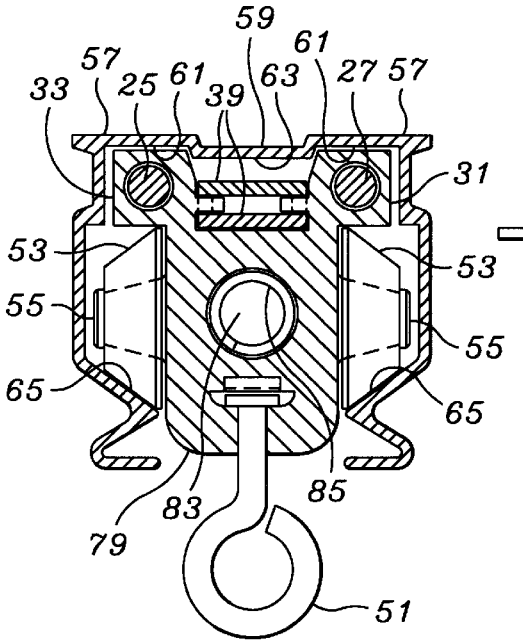
FIG. 5 is a sectional view of the carrier of FIG. 2, with elevated spacers and illustrating the through bore internally located worm gear.

Referring to FIG. 5, a sectional view of the carrier 83 of FIG. 2 taken along line 5—5 illustrates the internal bore 83 as having an internally disposed smooth surface 85. Again is shown the profile of the frusto conical axle 55.

Figure 6:
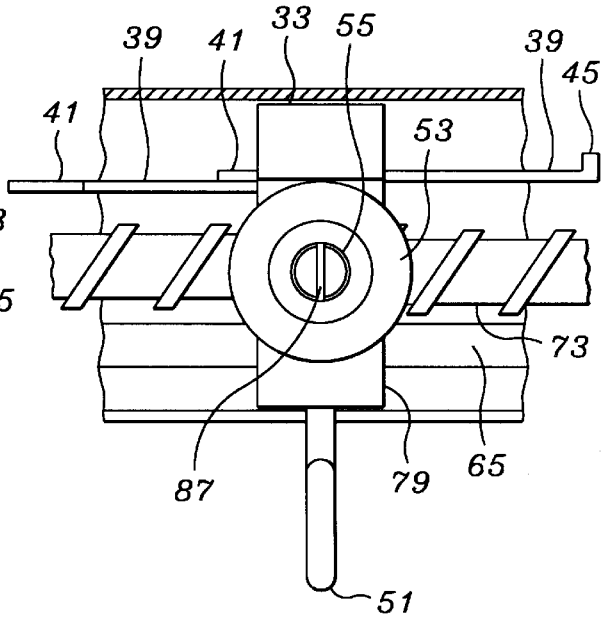
FIG. 6 is a side view of the carrier of FIG. 5.

Referring to FIG. 6, a side sectional view of the track 23 illustrates the carrier 83. Again, a combination of FIGS. 5 and 6 again illustrate a snap fit operation.

Figure 7:
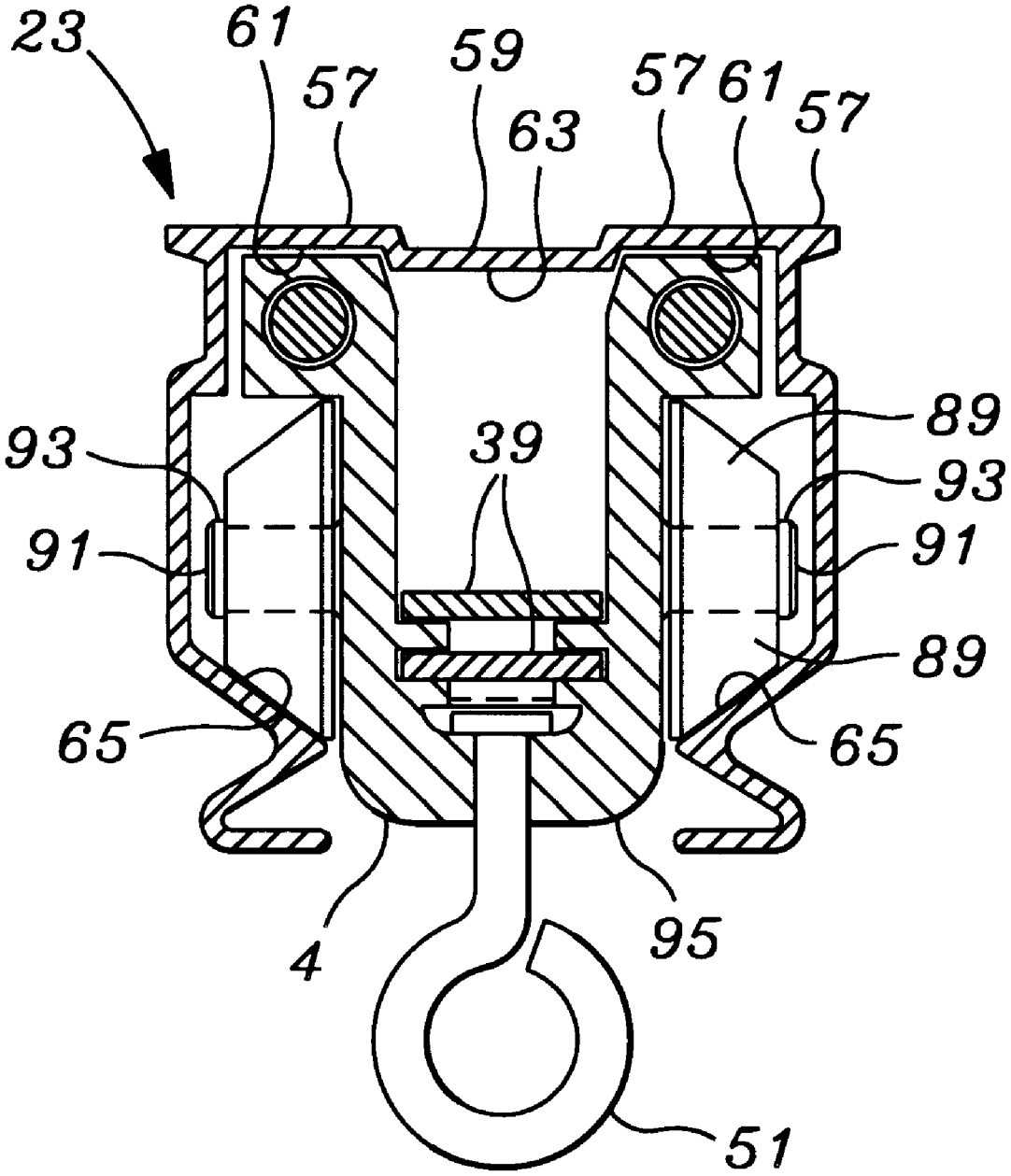
FIG. 7 is a sectional view similar to FIG. 3, but illustrating a frusto-conical wheel and a straight or cylindrical shaped axle.

Referring to FIG. 7, a view as shown in FIG. 3 is illustrated, but a wheel 89 is shown having a frusto-conical outer surface. However, it rides on an axle 91 which has an expanded head 93, but is cylindrical in shape, and which extends from a carrier 95. An internal bore of wheel 89 has a matching cylindrical surface. This configuration lacks a greater force transmission connection with the body of the carrier 95, and also lacks an expanded bearing surface between axle 55 and wheel 53 but maintains the second advantage of having a force component are directed toward the upper middle of the body of the carrier 95, thus reducing some of the shear force on the axle 91.

Figure 8:
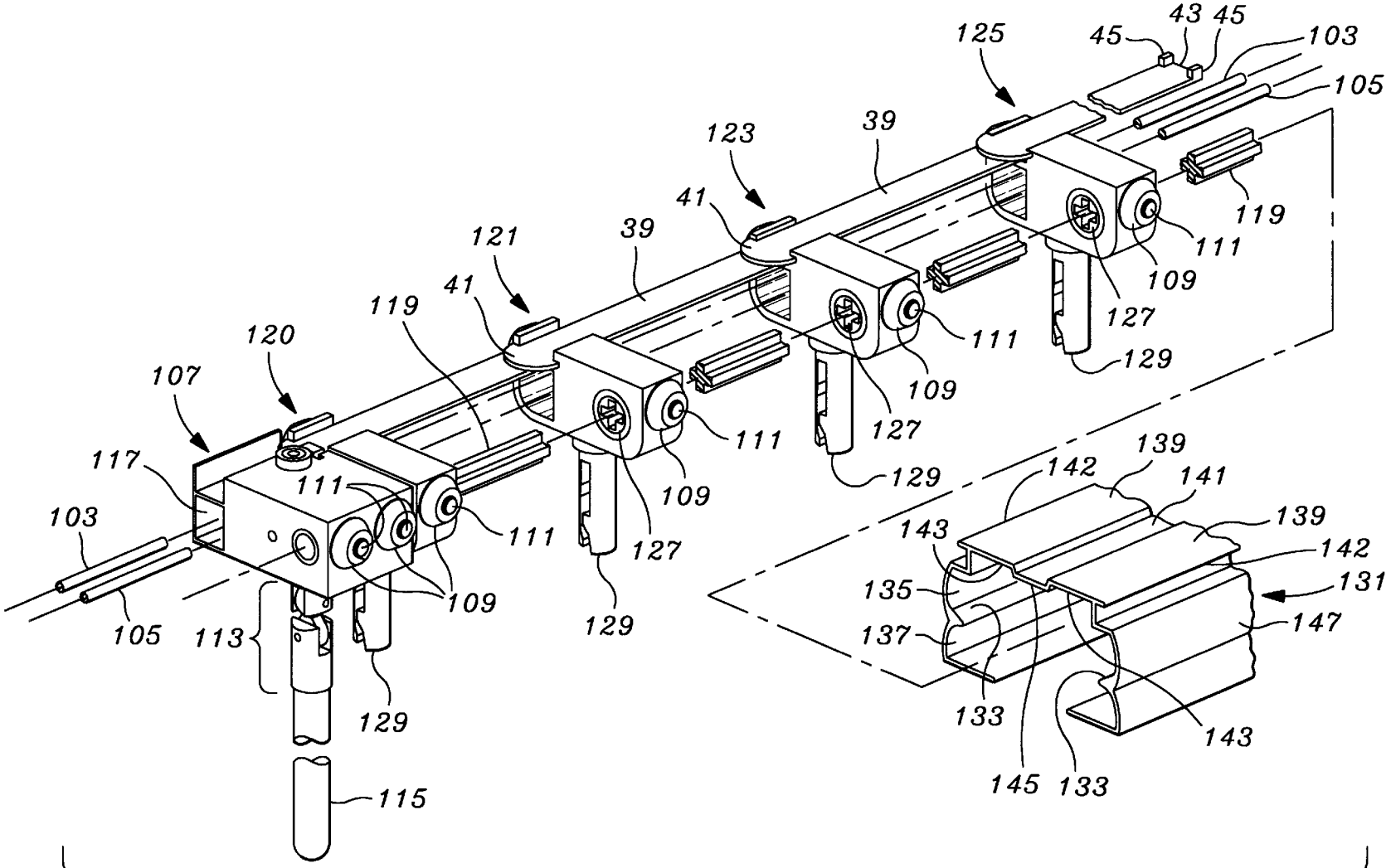
FIG. 8 is a perspective partially exploded view of the system used with a vertical blind configuration having vertical blind element carriers and a central actuation rod and side spacers.

Referring to FIG. 8, a vertical blind system 101 is shown which incorporates the sloped, self centering principles and structures seen in FIGS. 1–7. A pair of pull ropes 103 and 105 are shown which may extend through a lead or pull carrier 107. The pull carrier has two pairs of frusto-conical wheels 109 supported by associated axles 111. The pull carrier 107 has a universal swivel assembly 113 which is attached to a wand 115 to insure that user operation in any direction can be used to actuate the pull carrier 107. The pull carrier 107 has an opening 117 to accommodate the ropes 103 and 105, and the configuration shown can operate in either a cord actuated mode or a pull actuated mode.

A rotatable, bar having a cross-shaped, cross-sectional shape 119 is shown periodically between the pull carrier 107, a closely attached follower carrier 120, and a series of follower carriers 121, 123 and 125. The rotation of the bar 119 turns a worm gear sleeve 127 within each of the follower carriers 120 (the sleeve 127 is not seen within carrier 120), 121, 123, and 125, and the pull carrier 107 to rotate a series of vertically downwardly extending vane supports 129 to cause vertical blind panels (not shown) to rotate between a closed position and a light admitting open position.

Between the carriers 107, 121, 123 and 125, the same series of slidably displaceable spacer tabs 39 having head end portions 41 and tail end portion 43, as were seen in FIGS. 1–7, are illustrated. A track 131 illustrated is wider than track 23, but has many of the same overall features. Track 131 is wider, but it has a pair of inclined raceways 133 which are higher up, and which divide the track into an upper chamber 135 in which the wheels 109 of the carriers 107, 121, 123 and 125 will move, and a lower chamber 137 which accommodates the lower portion of the carriers 107, 120, 121, 123 and 125, and provides some blockage of the light space between the tops of the vertical blind panels (not shown) and the lower portions of the carriers 107, 121, 123 and 125. One reason to have material on the track 131 below the lowermost extent of the pair of inclined raceways 133 is to reduce, as much as possible, the clearance between the track 131 and the top of the vertical blind panels (not shown) in order to shut out as much light as possible when the vertical blind system is closed. To the extent that this can be accomplished, the vertical blind system 101 will shut out light to the greatest extent when the vertical blind system is fully assembled, installed, and in the closed position.

Track 131 also has a pair of spaced apart, parallel raised portions 139 which are separated by a central depression portion 141. A pair of side lips 142 extend along the upper side of the track 131 and can be used to provide support by engaging with various brackets and other structures used to suspend the tracks, such as track 131. Inside the track 131 and at the upper part of the upper chamber 135, a pair of internal raised portions 143 correspond with the portions 139, while a central internal depression 145 corresponds with the central depression portion 141. The external appearance of the track 131, and particularly the exterior side portion 147 may take on a variety of appearances, particularly since this is the portion which will be seen once the track 131 is installed. The internal structures are the most important, and all of the exterior structures of the track 131 may take on any configuration which is aesthetically pleasing.

Figure 9:
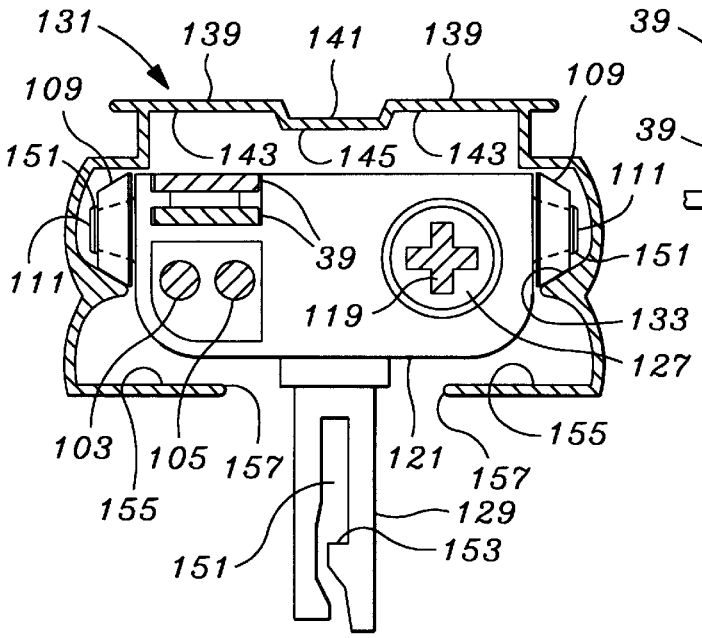
FIG. 9 is a sectional view of the embodiment of FIG. 8 illustrating the carrier within the track and showing the engagement of frusto-conical wheels on the sloped raceways.

Referring to FIG. 9, a cross sectional view of a carrier 121 of FIG. 8 illustrates that the wheels 109 not only are frusto-conically shaped, but that the axle 111 is also frusto-conically shaped, and terminates in a slightly enlarged end portion 151 to "snap" the wheel 109 in place. Notice the clearance between the top of the carrier 121 and the under surfaces 143, 145 of the track 131. The stabilizing influence of the rod 119 is the main structural element which helps keep the carriers 107, 121, 125, and 127 in alignment, and the upper inside surfaces 143 and 145 are not, in this configuration, necessary to be relied upon. The vane supports 129 are seen to have a slot 151 with a holding ledge 153. The track 131 terminates at its lower extent in a pair of opposing horizontal portions 155, each of the opposing horizontal portions 155 terminating in a pair of opposing edges 157. The horizontal portions 155 and edges 157 both protect and shield the carriers 107, 121, 123 and 125, and provide a greater degree of aesthetic, by visually covering the internals of the vertical blind system 101 to give the resulting vertical blind system 101 a more pleasing appearance.

Figure 10:
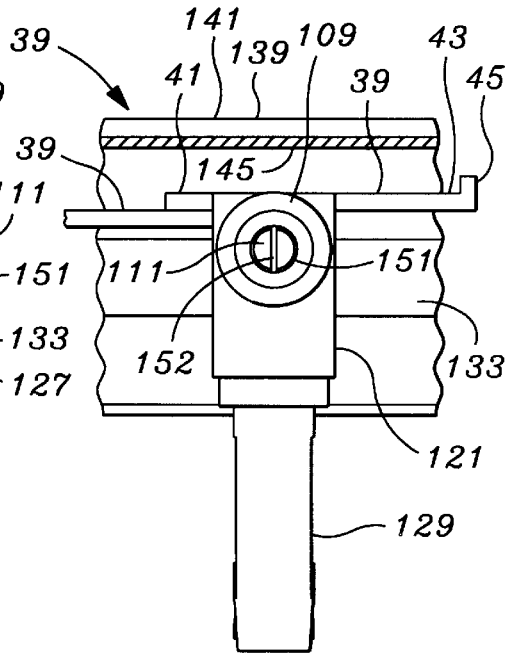
FIG. 10 is a side view of the carrier of FIG. 9.

Referring to FIG. 10, a side view of the track 131 and carrier 121 is shown in operating position. Note that the pair of inclined raceways 133 have a lower edge, but as they extend upwardly, they blend into the side wall of the track 131. The operation of the spacer tabs 39 is also better illustrated. The wheel 109 is seen with its frusto-conical surface exposed. A groove 152 is also seen to facilitate the snap action of the slightly enlarged end portion 15 1.

Figure 11:
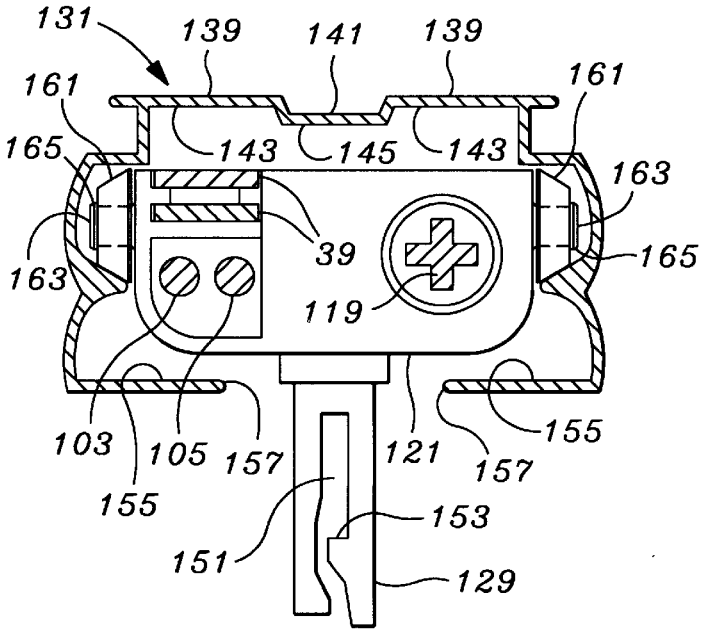
FIG. 11 is a sectional view of the carrier and track similar to that shown for FIG. 9, but having a frusto-conical wheel and a straight or cylindrical shaped axle.

Referring to FIG. 11, a modified version of many of the same structures seen in FIG. 9 is shown, but with a set of wheels 161 having a frusto-conical bearing surface as was seen in earlier Figures, but with a straight cylindrical axle 163 having an enlarged locking head 165.

Figure 12:
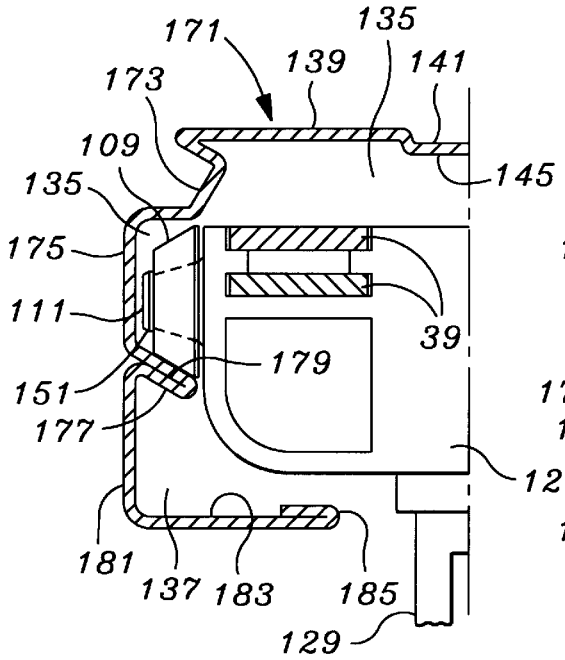
FIG. 12 is a half view similar to the full view of FIG. 9, but illustrating a full (180°) fold in a folded extrusion where the sloped raceway is formed as a fold in the side wall of the extrusion and can be used for either the drapery embodiments of FIGS. 1–7, or the vertical blind embodiments of FIGS. 8–11.

Referring to FIG. 12, a half view similar to the full view of FIG. 9, but emphasizing a track 171 is shown. The track 171 has the same upper external and internal features numbered, including upper chamber 135, lower chamber 137, pair of spaced apart, parallel raised portions 139, and central depression portion 141. However, beyond the raised portions 139, the upper edge does not form a half "T" shape with side lips 142 as was seen in extrusion track 131 because the track 171 is made from a single sheet of material which is of the same cross sectional thickness throughout its width and length. As a result, the raised portion 139 bends into a groove space 173 and then out and down at an upper section 175 to form an upper portion of the outer wall. The material then angles inward to form a sloping track portion 177 including an internal sloping track surface 179. At the end of the internal sloping track surface 179, the material takes a 180° turn to form a fold, with the material then extending upwardly in parallel to the material forming the sloping track portion 177 up to the point at which the sloping track portion 177 turned inwardly. At this angled point, the material is acutely angled downward, generally in parallel with the upper section 175 to form a lower section 181. Lower section 181 continues downward to a lower extent and then turns toward the center of the track 171 and extends toward the downwardly extending vane support 129, to form a horizontal portion 183. At the inward most portion of the horizontal portion 183, the material of construction again turns upwardly and back toward the outside to form a second 180° fold 185 which is also the inner edge of the track 171. This fold 185 is for safety and to form a smooth surface to protect users who handle and install the system 101, as well as users who might change or modify the individual vertical blind panels (not shown).

Figure 13:
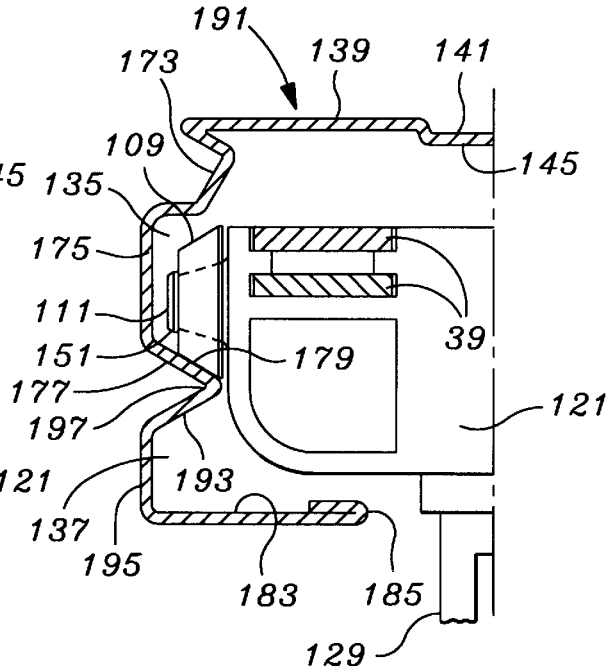
FIG. 13 is a half view similar to the view of FIGS. 9 & 12, but illustrating an angled bend in a folded extrusion where the sloped raceway is formed as an upper member of an angled wall in the side wall of the extrusion, the lower member extending outward and then downward and again can be used for either the drapery or vertical blind embodiments.

Referring to FIG. 13, a half view similar to the view of FIGS. 9 & 12 is shown, but where the raceway is not formed with a 180° fold. A track 191 is illustrated where the material extends in a way similar to track 171 up to and including the formation of the upper section 175 and its angled transition into a sloping track portion 177 including an internal sloping track surface 179. At the end of the internal sloping track surface 179, the material takes an acute angle turn to form a shape similar to a">" or "side-V." The lower portion of the "side-V" is 193 and extends back to the plane of the upper section 175 where it extends downward parallel to the upper section 175 to form a lower section 195. The area between the upper section 175 and the lower section 195 defines the "V" shaped notch 197. Below the lower section 195, the material continues to form the already seen horizontal portion 183, and fold 185 which is also the inner edge of the track 191.

Figure 14:
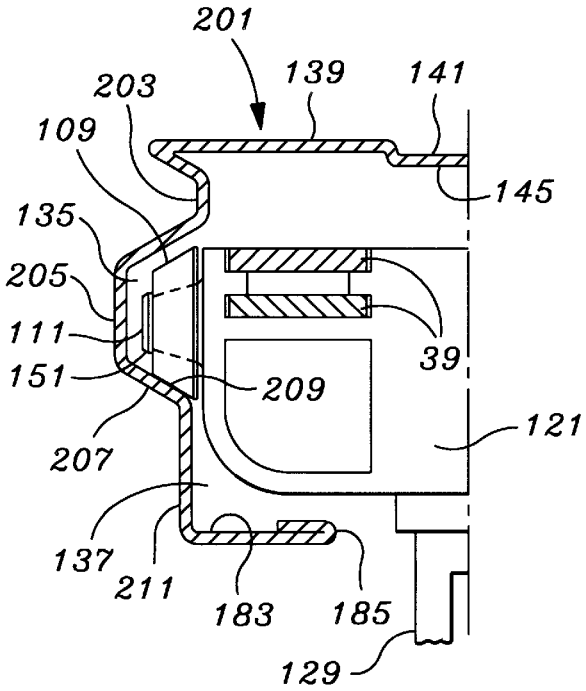
FIG. 14 is a half view similar to the view of FIGS. 9, 12, & 13, but illustrating formation in angled bend which follows the frusto-conical wheel and where sloped raceway is formed as a lower member of an inwardly directed frusto-conical shape and again can be used for either the drapery or vertical blind embodiments.

FIG. 14 is a half view similar to the view of FIGS. 9, 12, & 13, but illustrating a narrower lower portion of a track 201. In track 201, the material forming track 201 extends in a way similar to track 171 except that the pair of spaced apart, parallel raised portion 139 half extends a bit farther out and then drops back to form a somewhat deeper groove space 203, with a more vertically shaped mid-wall. From the groove space 203, the material extends downwardly at an angle paralleling generally the angle of the frusto-conical surface of the wheel 109, extending at an outward angle. The material then turns down and extends vertically to form an upper section 205, which unlike upper section 175 of the embodiment of FIGS. 12 and 13, will be the single outward most extent of the track 201.

The upper section 205 has a vertical extent similar to the diameter of the smaller diameter of the wheel 109, but somewhat smaller still since it is displaced outwardly of the wheel and can thus still provide adequate clearance. At the lowermost extent of the upper section 205, the material angles inward to form a sloping track portion 207 which has an internal sloping track surface 209 which matches the angle and surface of the frusto-conical surface of the wheel 109.

From the lowermost extent of the sloping track surface 209, the material extends to a vertical orientation, forming a lower section 211 which is more narrowly displaced toward the centerline of the track 201 than the upper section 205, and thus defines a narrower lower chamber 137. The material then extends horizontally to form the already seen horizontal portion 183, and fold 185 which is also the inner edge of the track 201.

While the present invention has been described in terms of a drapery track system and a vertical blind system, one skilled in the art will realize that the structure and techniques of the present invention can be applied to many similar appliances. The present invention may be applied in any situation where flexible resistance to lateral forces and a self centering support mechanism is desired to be combined with the linear translation ability of a track and carrier mechanism.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A track system comprising:

an elongate track having a pair of opposing sloped raceway surfaces;

a plurality of carriers axially moveable within said elongate track;

a plurality of extended axle members extending from each of said plurality of carriers;

a plurality of wheels having frusto-conical outer surfaces complimentary to said pair of opposing sloped raceway surfaces, each rotatably supported by an associated one of said axle members and rotatably supporting each one of said plurality of carriers and wherein each of said wheels carry a frusto conical bore and wherein each said axle member has a frusto conical outer surface complementary to said frusto-conical bore of each of said wheels, whereby the bearing forces of said track against said carrier are transmitted toward said carrier through said frusto conical axle member to enable said carrier to become self centerlining.

2. The track system of claim 1 wherein said sloped raceway surfaces are inclined from about 25° to about 35° from the horizontal.

3. The track system of claim 1 wherein each of said plurality of carriers have a downwardly extending support loop for supporting a drapery covering.

4. The track system of claim 1 wherein each said axle member terminates in an enlarged end having an expanded head with a groove across an end face of said expanded head to facilitate snap mounting of said wheels having a frusto-conical bore onto said plurality of axle members for rotational retention of said wheels onto said axle members.

5. A track system comprising:

an elongate track having a pair of opposing sloped raceway surfaces;

a plurality of carriers axially moveable within said elongate track;

a plurality of extended axle members extending from each of said plurality of carriers;

a plurality of wheels having frusto-conical outer surfaces complimentary to said pair of opposing sloped raceway surfaces, each rotatable supported by an associated one of said axle members and rotatably supporting each one of said plurality of carriers and wherein said elongate track has a central depression portion and where each of said carriers has a pair of upper blocks and wherein said carrier translatably moves within said track with said upper blocks partially separated by said central depression portion.

6. The track system of claim 5 wherein each of said plurality of carriers have a "U" shaped space slidably supporting a slidably displaceable spacer tab connected to another carrier to set a maximum spacing between a set of adjacent carriers.

* * * * *